US008360054B2

(12) United States Patent
Peyron et al.

(10) Patent No.: US 8,360,054 B2
(45) Date of Patent: Jan. 29, 2013

(54) DEMAND VALVE DEVICE FOR USE BY DIVERSE AND SELECTIVELY CONNECTABLE FLUIDIC CONNECTOR

(75) Inventors: Nicolas Peyron, Saint Jeannet (FR); Stephane Carepa, Saint Laurent du Var (FR)

(73) Assignee: La Spirotechnique, Carros (FR)

( * ) Notice: Subject to any disclaimer, the term of this patent is extended or adjusted under 35 U.S.C. 154(b) by 733 days.

(21) Appl. No.: 12/511,671

(22) Filed: Jul. 29, 2009

(65) Prior Publication Data

US 2010/0186746 A1 Jul. 29, 2010

(30) Foreign Application Priority Data

Aug. 6, 2008 (FR) ..... 08 55442

(51) Int. Cl.
*A62B 9/00* (2006.01)
*B63C 11/22* (2006.01)

(52) U.S. Cl. ..... 128/201.27; 128/200.29

(58) Field of Classification Search ..... 128/201.28, 128/205.24, 200.29, 201.27
See application file for complete search history.

(56) References Cited

U.S. PATENT DOCUMENTS 4,192,298 A * 3/1980 Ferraro et al. ..... 128/205.24

FOREIGN PATENT DOCUMENTS

| | | |
|---|---|---|
| EP | 0903529 | 3/1999 |
| FR | 2367655 | 5/1978 |
| WO | 2007024842 | 3/2007 |

OTHER PUBLICATIONS

French Search Report for FR 0855442 dated Mar. 27, 2009.
Search Report for FR 710721.

* cited by examiner

*Primary Examiner* — Stephen Crow
(74) *Attorney, Agent, or Firm* — Elwood L. Haynes

(57) ABSTRACT

Device comprising a demand valve (1) for delivering breathable gas to a diver and a fluidic connector (2, 5) that can be selectively connected to the demand valve (1), the demand valve (1) comprising a breathable gas supply inlet (3, 13), characterized in that the demand valve (1) and/or the fluidic connector (2, 5) comprise a blocking device (6, 7, 8, 9; 6, 7, 66, 50) for selectively blocking the connector (2, 5) on the demand valve (1) when the connector (2, 5) is fastened to the demand valve (1) via the catching members (103, 12; 213, 5), the blocking device (6, 7, 8, 9; 7, 66, 50) being selectively moveable and/or deformable between a first configuration of blocking relative movement between the demand valve (1) and the connector (2, 5), and a second configuration of unblocking, allowing relative movement between the demand valve (1) and the connector (2, 5).

19 Claims, 4 Drawing Sheets

DEMAND VALVE DEVICE FOR USE BY DIVERSE AND SELECTIVELY CONNECTABLE FLUIDIC CONNECTOR

This application claims priority to French Patent Application FR 0855442 filed Aug. 6, 2008.

FIELD OF INVENTION

The present invention relates to a device comprising a demand valve for a diver and a fluidic connector that can be connected to said demand valve.

The invention relates more specifically to a system allowing quick connection between a demand valve of a diver's breathable gas supply system and a fluid connector (a hose, a valve seat retainer, etc.) that can be connected to said demand valve.

BACKGROUND

The demand valve is that part of the regulator that the diver holds in his mouth and which delivers the air to the diver as he inhales.

The casing of the demand valve at least partially contains the mechanism for regulating the pressure of and delivering the gas from the source via a supply hose. This pressure-regulating mechanism allows the gas carried by the hose to reach, selectively, an outlet intended to be connected to the diver's mouth (as a function of the external pressure and/or of the inhalation pressure). The systems providing the connection between a diver's demand valve and a fluidic connector (a hose, a valve seat retainer, etc.) generally comprise a system of the screw-nut type.

In certain known embodiments, the pressure-regulating valve part of the demand valve is housed in an insert arranged in a bore of the demand valve casing. That end of the insert that is situated in the casing also bears the lever of the pressure-regulating mechanism which collaborates with a flexible diaphragm situated on one side of the casing.

According to a first possible arrangement, the pressure-regulating valve seat is also housed in the insert. In such a case, the hose carrying the gas is then screwed directly onto the exterior end of the insert.

According to a second possible arrangement, the pressure-regulating valve seat is housed in a separate seat retainer which is coupled (for example by screw-fastening) to the exterior end of the insert. In such a case, the gas supply hose is then screwed not onto the insert but onto an end of the seat retainer.

Suitably robust screw-fastening and sealing are conventionally ensured by imposing a sufficiently high tightening torque. This tightening does, however, require suitable tightening tools (open-ended spanner, pin wrench, etc.) which are not necessarily available when needed. In addition, it is not easy for the user to identify that he has applied a sufficient tightening torque.

It is an object of the present invention to remedy all or some of the abovementioned disadvantages of the prior art.

SUMMARY OF THE INVENTION

The present invention relates to a device comprising a demand valve for delivering breathable gas to a diver and a fluidic connector that can be selectively connected to the demand valve, the demand valve comprising a breathable gas supply inlet, the fluidic connector being intended to be fastened removably at the supply inlet to carry breathable gas into the valve, the supply inlet of the demand valve and the fluidic connector comprising complementary respective catching members forming a removable fastening system, of the screw thread/tapped thread type, for example.

DETAILED DESCRIPTION OF THE INVENTION

Figure 1:
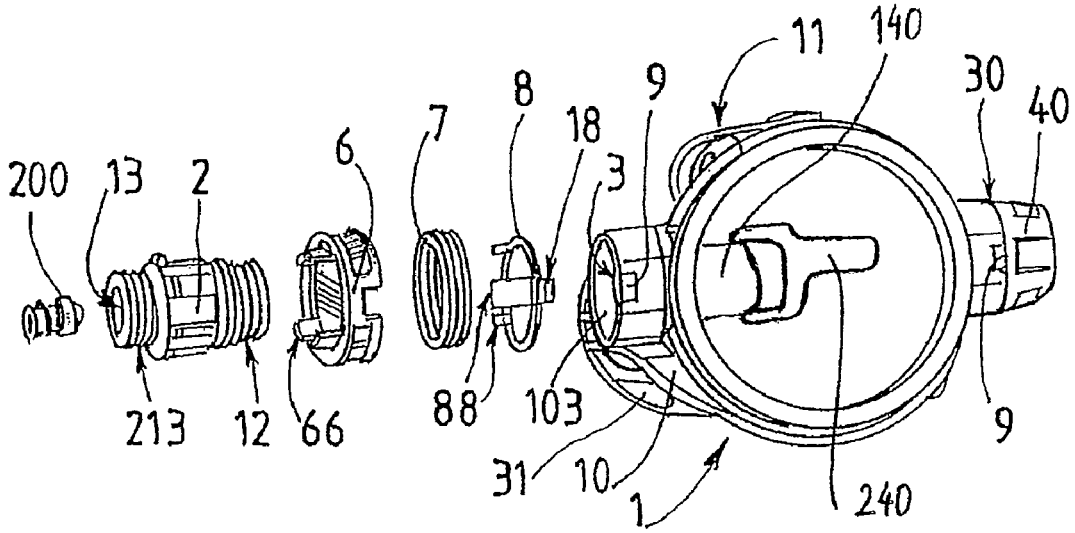
FIG. 1 depicts an exploded and partial perspective view of an assembly of a demand valve casing with a regulating valve retainer according to one exemplary embodiment of the invention.

To this end, the device according to the invention, in other respects in accordance with the generic definition given thereof, is essentially characterized in that the demand valve and/or the fluidic connector comprise a blocking device for selectively blocking the connector on the demand valve when the connector is fastened to the demand valve via the catching members, the blocking device being selectively moveable and/or deformable between a first configuration of blocking relative movement between the demand valve and the connector, to prevent disconnection of the catching members and a second configuration of unblocking, allowing relative movement between the demand valve and the connector, to allow disconnection of the catching members.

Further, some embodiments of the invention may comprise one or more of the following features:

- the demand valve comprises a casing provided with a port that forms the breathable gas supply inlet in which there is positioned an insert housing a pressure-regulating valve, the fluidic connector comprising a pressure-regulating valve seat retainer, the complementary respective catching members being situated respectively, on the one hand, at a first end of the pressure-regulating valve seat retainer and, on the other hand, at an outer end of the insert and/or at the port in the casing,
- the blocking device comprises a locking piece situated on the seat retainer or, respectively, on the demand valve, and an end stop situated on the demand valve or, respectively, on the seat retainer, the locking piece being able to be moved selectively between a first position of collaboration with the end stop corresponding to a configuration of blocking relative rotational movement between the demand valve and the seat retainer and a second position of non-collaboration with the end stop corresponding to a position of unblocking the relative rotational movement between the demand valve and the seat retainer,
- the locking piece is urged, for example via a blocking device return member towards the first position in order automatically to block the connection of the seat retainer to the demand valve when the seat retainer is fastened to the demand valve via the catching members, the demand valve comprises a casing provided with a port in which there is positioned a support piece for at least a part of a valve mechanism for regulating the pressure of the breathable gas, said support piece having an inner first end directed towards the casing and a second end directed towards the outside of the casing, the second end of the support piece comprising a port forming the breathable gas supply inlet, the fluidic connector comprising a gas supply pipe one end of which comprises a connecting head intended to be fastened removably to the second end of the support piece, the complementary respective catching members being situated respectively at the connecting head of the supply pipe and at the second end of the support piece, the blocking device comprises a locking piece situated on the casing and/or on the support piece and an end stop situated on the connecting head for connection to the supply pipe, the locking piece being able to be moved selectively between a first position of collaboration with the end stop corresponding to a position of blocking a relative rotational movement between the connecting head and the support piece casing assembly, and a second position of non-collaboration with the end stop corresponding to a position of unblocking the relative rotational movement between the connecting head and the support piece casing assembly, the blocking device comprises a locking piece situated on the connecting head and an end stop situated on the casing and/or on the support piece, the locking piece being able to be moved selectively between a first position of collaboration with the end stop corresponding to a position of blocking a relative rotational movement between the connecting head and the support piece casing assembly, and a second position of non-collaboration with the end stop corresponding to a position of unblocking the relative rotational movement between the connecting head and the support piece casing assembly, the locking piece is urged towards its first position for example via a return member in order automatically to block the connection between the connecting head and the support piece when the connecting head is fastened to the support piece via the catching members, the support piece comprises an insert housing a pressure-regulating valve and a valve retainer separate from the insert housing a valve seat, the insert being housed in a port in the housing, the seat retainer having a first end coupled removably (for example by screw-fastening) to the insert and a second end forming the second end of the support piece intended to be fastened removably to the connecting head, the first end of the pressure-regulating valve seat retainer and the second end of the insert comprise complementary respective catching members forming a system for removably fastening the seat retainer into the port of the casing (particularly of the screw thread/tapped thread type), the demand valve and/or the seat retainer comprising a blocking device for selectively blocking the seat retainer on the demand valve when the seat retainer is fastened to the insert via the catching members, the blocking device being selectively moveable and/or deformable between a first configuration of blocking relative movement between the demand valve and the seat retainer, to prevent disconnection of the catching members and a second configuration of unblocking, allowing relative movement between the demand valve and the seat retainer to allow disconnection of the catching members, the support piece comprises an insert housing both a pressure-regulating valve and a valve seat, the insert being housed in a port in the casing and comprising a first end housed in the casing and a second end forming the second end of the support piece intended to be fastened removably (for example by screw fastening) to the connecting head, the device comprises a stop piece formed on the connecting head of the supply pipe and/or on the support piece, the stop piece being shaped in such a way as to limit, through abutment, the end position of fastening of the connecting head of the supply pipe to the second end of the support piece, the complementary respective catching members comprise a screw thread and tapped thread system, the removable fastening members and the locking/unlocking members can be operated by hand, preferably without tools, the complementary respective catching members of the connector and of the demand valve may comprise any male/female fastening system such as a screw thread/tapped thread, a fastening system of the bayonet type or the like, it being equally possible for the male parts (the threaded end or the bayonet end) to be on either one of the two pieces that are to be fastened removably or such that they can be disassembled, the locking piece is capable of translational movement between its first position and its second position, the locking piece comprises at least one portion for grasping allowing it to be moved by hand from its first position into its second position, the return member that urges the locking piece towards its first position comprises a spring, for example a compression spring, the spring is of the helical type, the spring is mounted on the connector and is held in place between, on the one hand, an end stop formed on the connector and, on the other hand, the locking piece, the locking piece has the overall shape of a ring of which at least one end forms at least one pin intended to collaborate or not to collaborate with at least one end stop, the end stop or stops form one or more housings that accommodate at least one portion of the locking piece, for example that accommodate the end of the locking piece that forms one or more pins, the male and female parts of the complementary respective catching members of the connector and of the demand valve are respectively indexed on the connector and on the demand valve so that when the connector comes into a determined fastening position with respect to the demand valve, the locking piece or pieces are positioned next to the end stop or stops (or accommodating housings of the locking piece), the blocking device for selectively blocking the connecting head on the seat retainer or on the insert and the blocking device for selectively blocking the seat retainer on the insert have one or more part(s) in common, at least one of the blocking devices comprises, or is made of, plastic, at least one of the catching members (particularly a screw thread/tapped thread) comprises, or is made of, plastic, the demand valve comprises an additional port intended to accommodate a mechanism for controlling the flow of gas inside the demand valve, such as a venturi flap or some way of adjusting the breathing effort, the breathable gas supply inlet and the additional port being situated respectively at two distinct ends of the demand valve and being of the same kind, so that the seat retainer and the mechanism for controlling the flow can be fitted selectively to either of the two ends of the casing, the demand valve comprise a casing delimiting a volume for a mechanism for regulating the pressure of the breathable gas, the casing comprising at least one breathable gas supply inlet and an outlet end for the gas the pressure of which has been regulated by the pressure-regulating mechanism, the outlet end of the casing being intended to be housed in a user's mouth, the moving locking piece or pieces is/are preferably situated on the so-called "fixed" parts of the device, that is to say on the seat retainer or on the casing, the demand valve comprises a casing, the demand valve comprising a first fluidic connector that can be selectively connected to the casing via respective first catching members with screw thread and tapped thread, the demand valve device comprising a first blocking device comprising at least one first moving locking piece situated on the first fluidic connector and at least a first end stop situated on the demand valve, the first blocking piece being able to be moved selectively between a first position of collaboration with a first end stop corresponding to a configuration of blocking a relative rotational movement between the casing and the first fluidic connector and a second position of non-collaboration with a first end stop corresponding to the unblocking of the relative rotational movement between the demand valve and the first fluidic connector, the first locking piece being urged towards its first position via a return member, the device comprising a second fluidic connector comprising a gas supply pipe one end of which comprises a connecting head intended to be fastened removably to one end of the first connector via second respective catching members with screw thread and tapped thread, the demand valve device comprising a second blocking device comprising at least a second moving locking piece situated on the first connector and at least one second end stop situated on the connecting head, the second locking piece being able to be moved selectively between a first position of collaboration with a second end stop to block the relative rotational movement between the head and the first connector and a second position of non-collaboration with a second end stop to unblock the relative rotational movement between the head and the first connector, the second locking piece being urged towards its first position via a return member, the first fluidic connector comprises an insert or valve seat retainer, the second fluidic connector comprises a hose equipped with a connecting head, the first and second blocking devices have at least one part in common, the first and second moving locking pieces are urged towards their respective first position by the one same return member, the second blocking device comprises several second moving locking pieces and several meeting second end stops situated on the connecting head and defining several different possible positions of collaboration between locking pieces and end stops according to the relative angular positions of the head and of the first connector, the various positions of collaboration of the locking pieces with the end stop or stops form successive safety catches blocking the rotation of the head with respect to the connector, in the assembled position, the second blocking device and/or the head forms an end stop limiting the movement of the first locking piece or pieces towards the second position thereof, in order to prevent the first catching members from being disassembled when the head has not previously been disconnected from the first connector, all or some of the constituent parts of the first and/or of the second blocking devices are holed and, in particular, the first locking piece and/or the second locking piece is holed so as to allow water and/or sand to circulate through its thickness, the blocking device for blocking the connecting head on the support piece comprises several moving locking pieces capable of collaborating with several end stops according to various distinct locking configurations corresponding respectively to several successive locking catches according to the relative positions of screwing of the head onto the support piece.

What that means is that the invention can cover a device comprising a demand valve, a first connector that can be screwed onto a port of the demand valve, this first connector comprises for example part of the pressure-regulating valve mechanism such as a valve seat retainer or an insert, a hose equipped with a connecting head constitutes a second connector, this connecting head can be screwed onto the first connector and/or onto the demand valve, each screwed connection (on the one hand, between the demand valve and the first connector and, on the other hand, between the head of the hose and the first connector or the demand valve) comprises a blocking device comprising a moving locking piece allowing the screw-fastening to be blocked, each locking piece is, by default, urged into a position of blocking the screw fastening in order to prevent unscrewing.

Advantageously, the two locking mechanisms have parts in common, for example at least one spring urging the locking pieces into the respective blocking positions.

The invention also relates to a demand valve for a diver, comprising a casing housing a mechanism for controlling the gas delivered to the diver, the casing comprises a port intended to accommodate a support piece of a pressure-regulating valve mechanism such as a valve retainer insert, the casing comprising at least one housing forming an end stop intended selectively to accommodate a moving locking piece of a fluidic connector such as a seat retainer or a connecting head of a hose such as to form a system for selectively locking the relative rotational movement between the casing and the connector.

The invention also relates to a gas supply pipe or hose for a demand valve for delivering breathable gas to a diver, comprising an end provided with a tapped connecting head intended to be screwed onto a threaded portion of a demand valve casing or threaded end of a support piece mounted in the demand valve casing, the connecting head comprising at least one accommodating housing intended to accommodate one end of a blocking locking piece borne by the casing or the support piece in order selectively by abutment to block the screwing/unscrewing of the connecting head when the latter is screwed onto the threaded portion of the casing or onto the threaded portion of the support piece.

The invention also relates to a pressure regulating valve seat retainer for a demand valve for supplying breathable gas to a diver, comprising an oblong body a first end of which is threaded to collaborate with a tapped port in a demand valve casing or with a tapped end of a pressure regulating valve retainer insert positioned in a port of a demand valve casing, the seat retainer comprising a locking device comprising a locking piece that can be moved selectively between a protruding first configuration and a retracted second configuration in order respectively to block or not to block the rotation of the seat retainer relative to the casing when the first end of the seat retainer is screwed onto the casing and/or the insert.

The invention also relates to a method of assembling/disassembling a connector on/from a demand valve using any one of the objects described hereinabove or hereinafter, in which the assembly (or disassembly) is supplemented by a locking, preferably automatic or by hand, (or manual unlocking) of the connection between the connector and the demand valve.

The invention may also relate to any alternative method or device comprising any combination of the features mentioned hereinabove or hereinbelow.

The invention may also relate to a device in which the demand valve comprises a casing provided with a port in which there is arranged an insert housing a pressure-regulating valve, a seat retainer having a first end coupled to the insert (for example by screw fastening), the seat retainer comprising a second end provided with a port forming the breathable gas supply inlet, the fluidic connector comprising a gas supply pipe one end of which comprises a connecting head intended to be fastened removably to the second end of the seat retainer, the complementary respective catching members (screw thread/tapped thread for example) being situated respectively at the connecting head and at the second end of the seat retainer.

The invention may also relate to a device in which the demand valve comprises a casing provided with a port in which there is positioned an insert housing both a pressure-regulating valve and a valve seat, the insert comprising a first end situated inside the casing and a second end directed towards the outside of the casing, said second end of the insert being provided with a portion forming the breathable gas supply inlet, the fluidic connector comprising a gas supply pipe one end of which comprises a connecting head intended to be fastened removably (for example by screw fastening) onto the second end of the insert, the complementary respective catching members being situated respectively at the connecting head and at the second end of the insert.

Other specific features and advantages will become apparent from reading the description given hereinafter, with reference to the figures. FIG. 1 illustrates a demand valve 1 comprising a casing 10 that has one end provided with a mouthpiece 11 for a diver (inhaled air) and an outlet 31 for exhaled gas. A lateral end of the casing may comprise a port formed by a bore 30 in which there is positioned a system 40 known per se for controlling and regulating the gas delivered to the diver towards the outlet (mechanism situated inside the casing, such as a venturi flap and/or a way of adjusting the breathing effort).

The other lateral end of the casing 10 comprises a cylindrical 103 bore (preferably symmetric and of the same kind as that 30 of the other lateral end) intended to accommodate an insert 140 housing a pressure-regulating valve. The insert 140 may also bear a lever 240 of the pressure-regulating mechanism. Conventionally, the lever 240 is designed to collaborate with a flexible diaphragm situated on the one side of the casing 1.

That end of the insert 140 that is situated toward the outside of the casing 1 is tapped to collaborate with a threaded first end 12 of a pressure-regulating valve 200 seat retainer 2.

Conventionally, the seat retainer 2 is a substantially cylindrical part intended to house the valve seat 200 which collaborates with the pressure regulating valve mechanism situated in the insert 140.

The second end of the seat retainer 2 is also threaded 213 to collaborate with the tapped end of a gas supply hose 15 connected to the first pressure-regulating stage for breathable gas from a source of pressurized gas.

According to one advantageous particular feature, the device comprises a system for selectively locking the assembly of the seat retainer 2 in the casing 10 (when the seat retainer is fastened to the insert 140 in particular).

Figure 2:
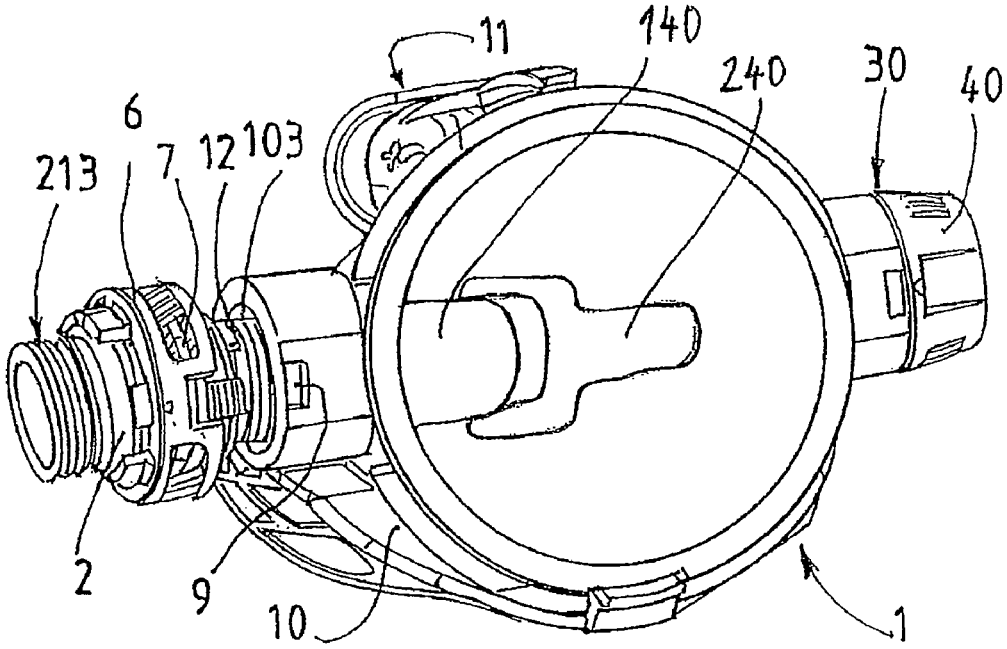
FIGS. 2 and 3 are views, in perspective and from the side respectively, of a detail of the mechanism of FIG. 1 in two successive positions of an assembly process.

In the entirely non-limiting example described, the locking system comprises a locking piece 8 in the form of a ring comprising at least one pin 18 intended selectively to collaborate with at least one housing 9 formed on the casing 10 (for example around the port 3 that houses the insert 140). The device also comprises a helical spring 7 and a ring 6. The ring 6, then the spring 7, then the locking piece 8 are mounted in that order on the first end 12 of the seat retainer 2 (cf. FIG. 2). This collection of parts is, for example, limited in its movement towards the second end 213 of the seat retainer 2 by the central body of the seat retainer 2. The threaded first end 12 of the seat retainer 2 can then be screwed into the port 3 of the casing 10 on the tapped exterior end of the insert 140 (cf. FIG. 2; it will be noted that the tapped end of the insert 140 is not visible in the figures because it is inside the bore of the casing 10).

Figure 3:
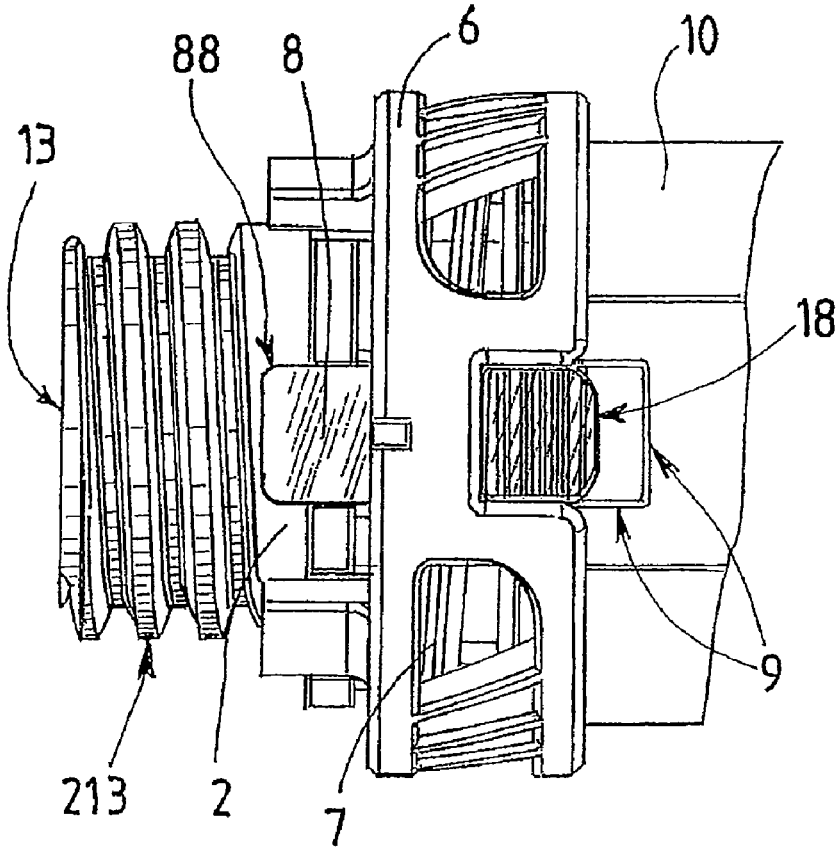
Figure 4:
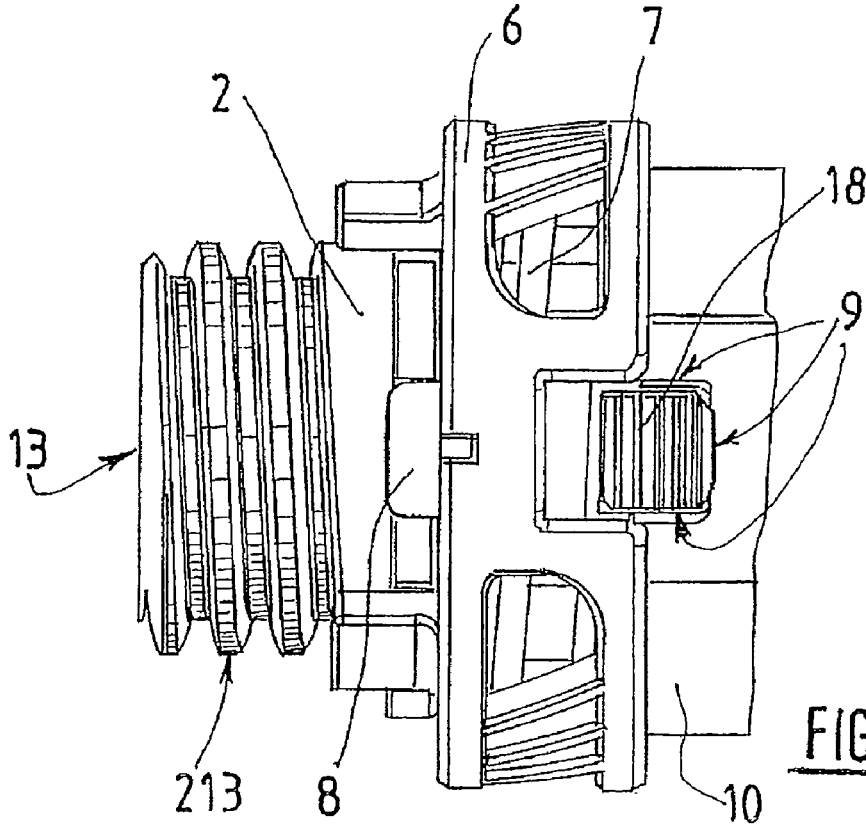
FIG. 4 depicts a side view of a detail of the mechanism of FIG. 2 in an assembled position.

When the threaded first end 12 of the seat retainer 2 has been screwed sufficiently onto the insert 140 in the port 3 of the casing, the end of the pin 18 of the locking piece 8 comes to face the housing 9 of the casing 10 (cf. FIG. 3). The spring 7 is compressed between the seat retainer 2 and the casing 10. The spring 7 urges and moves the locking piece 8 towards the casing 10 and causes the pin 18 (or locking pins 18 if there are several of these) to enter the housing(s) 9 (cf. FIG. 4). The locked position is automatically engaged.

The walls delimiting the housing 9 thus form an end stop blocking the rotation of the seat retainer 2 relative to the casing 10, preventing it from becoming unscrewed from the insert 140. Indeed the locking piece 8 rotates as one with the seat retainer 2, for example on account of tabs 88 extending towards the seat retainer 2 and collaborating with a longitudinal crenellation formed on the central part of the seat retainer 2.

For preference, the system for screwing the first end 12 of the seat retainer 2 onto the insert 140 situated in the housing 3 of the casing 10 is indexed in such a way that full screwing corresponds to the precise positioning of the pin(s) 8 facing the housing(s) 9.

Correct connection of the seat retainer 2 in the casing 10 is thus locked safely. In addition, the locking clearly indicates to the user that the connection has been made correctly.

This connection can be made by hand and quickly without the need for tools because a high tightening torque can be avoided thanks to the safety feature generated by the locking. In this way, the connecting systems (screw thread/tapped thread) can be made of plastic (the tightening torque required is relatively low and also suited to plastic parts).

To unlock the connection of the seat retainer 2, the user moves the locking piece 8 by hand towards the seat retainer 2 (against the action of the spring 7) (cf. FIG. 3). For that purpose, the pin 18 of the locking piece 8 may comprise a region for grasping, making this operation easier. When the pin 18 of the spring has left the housing 9, rotation of the seat retainer 2 relative to the casing 10 is no longer impeded and the user can unscrew the seat retainer 2 from the insert 140.

The user therefore performs two separate movements for disconnection (in this exemplary embodiment these are a translational movement of the locking piece 8 to unlock it followed by a rotational movement of the seat retainer 2 to unscrew it).

Figure 5:
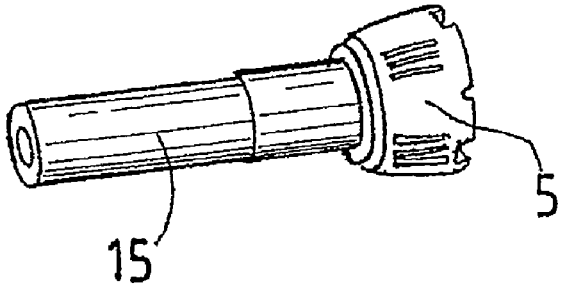
FIG. 5 depicts a perspective (and reduced-size) view of a detail of a supply hose according to one exemplary embodiment of the invention.

A locking system of this type may also be used for connecting a hose 15 (FIG. 5) at the threaded second end 213 of the seat retainer 2 (FIG. 1).

For that, the end of the hose 15 comprises a tapped head 5 (for example a nut).

Figure 6:
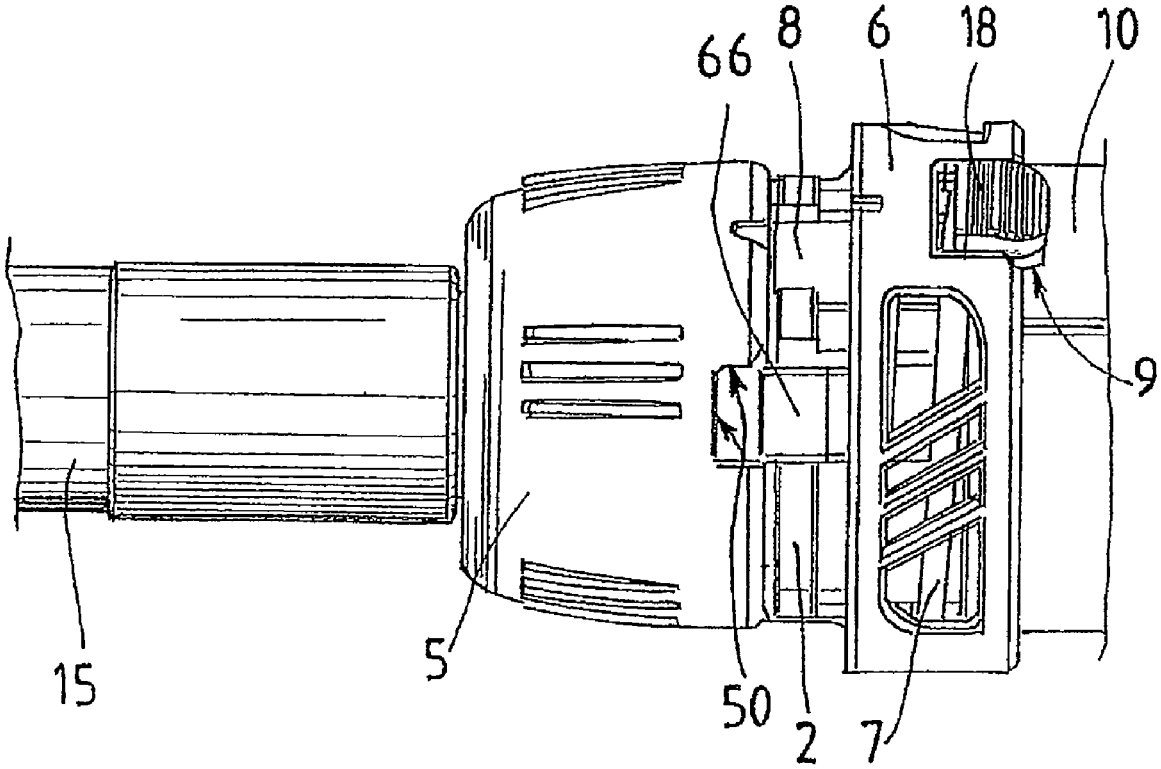
FIG. 6 depicts a side and partial view illustrating one phase of the fitting of a hose according to FIG. 5 on an assembly according to FIG. 1.

According to an advantageous particular feature, the head 5 of the hose 15 comprises at least one housing 50 intended to collaborate with one or more locking tabs 66 formed on the ring 6 (cf. FIG. 6).

The user can screw the head 5 by hand onto the threaded second end of the seat retainer 2. The screw thread is, for example, of the trapezoidal type.

Towards the end of screw fastening, the head 5 comes up against the end of the ring 6. As screw fastening is continued, the end of the head 5 pushes the ring 6 back towards the casing 10 (against the action of the spring 7, which thus becomes compressed). When the user reaches the end of screw-fastening, the locking tabs 66 formed on the ring 6 engage in the housings 50 in the head 5 (FIGS. 6 and 7), thus allowing the ring 6 to return to its initial position further forward towards the head 5 (less load on the spring 7). The system is thus automatically correctly locked to block the rotation of the head 5 relative to the seat retainer 2.

Correct connection between the hose 15, 5 and the seat retainer 2 is thus locked very faithfully. The locking clearly indicates to the user that the connection has been made correctly.

This connection can be made by hand quickly and without the need for tools because a high tightening torque can be avoided because of the safety feature generated by the locking. Thus, the connecting systems (screw thread/tapped thread) can be made of plastic (the tightening torque required is relatively low and as suitable for plastic parts as it is for metal parts).

To unlock the connection of the head 5 of the hose 15, the user moves the ring 6 by hand towards the casing (against the action of the spring 7). When the tabs 66 of the ring have left the housings 50 of the head 5, the rotation of the head 5 relative to the seat retainer 2 is no longer impeded and the user can unscrew the head 5 of the hose from the seat retainer 2.

The user therefore performs two separate movements for disconnecting (in this exemplary embodiment these are a translational movement of the ring 8 in order to unlock it followed by a rotational movement of the head 5 of the hose in order to unscrew it).

When the pin or pins 18 of the locking piece 8 have engaged in the housings 9 in the casing 10 there is thus a locked first quick connection between:

on the one hand, the seat retainer 2, and on the other hand, the casing 10 (or the insert 140-casing 10 assembly).

To unlock this first quick connection, the user has to get the pin or pins 18 of the locking piece 8 out of the corresponding notch or notches 9 by pushing the locking piece 8 towards the outside of the casing 10.

For preference, this first unlocking is rendered impossible when the hose 15 is connected to the other end of the seat retainer 2 because for preference, when the head 5 of the hose 15 is connected to the seat retainer 2 (2nd quick connection) the head 5 of the hose forms an end stop for the tabs 88 of the locking piece 8, preventing the pins 18 from leaving the housings 9.

This second quick connection (of the head 5 with respect to the seat retainer 2) is, for its part, disconnected by pushing the ring 6 towards the casing 10 (to make the tab or tabs 6 leave the housings 50).

For preference and advantageously the same spring 7 or return member returns both blocking elements (locking piece 8, 18 and ring 6, 66) corresponding respectively to the blocking of the two quick connections.

For preference, the ring 6 comprises several tabs 66 angularly distributed about the circular periphery thereof and intended to become housed in housings 50 of the head 5. For preference, the head 5 comprises more housings 50 than the ring 6 has tabs 66.

For example, the ring 6 comprises four tabs 66 and the head 5 comprises eight houses 50. If, by accident, the moving ring 6 is moved towards the casing 10 relative to the head 5 and the head 5 becomes partially unscrewed from the seat retainer 2, the ring 6 (pushed automatically by the spring 7 towards its previous position) will then cause the tabs 66 to collaborate again, this time with other housings 50.

This makes it possible automatically to achieve a new locked blocked position even in the event of accidental unlocking and partial unscrewing.

It will be possible to unlock the head 5 relative to the seat retainer 2 only after a certain number of unscrewing turns have been performed between the head and the seat retainer 2. For example, unlocking becomes possible only when three or four housings 50 have been passed.

Thus, according to an advantageous particular feature, the quick connection defines several successive locking catches (for example two, three or four catches) between the screwed parts (head 5 and seat retainer 2). The user has therefore to pass these successive catches (by unscrewing sufficiently) before the locking piece 6 can be unscrewed freely and unhindered.

If the user has accidentally unlocked and unscrewed the connection by one catch, two catches or three catches, the unscrewing of the head 5 is still prevented by the other remaining catches. When all the safety catches have been passed, a head 5 can be unscrewed freely.

For preference, the ring 6 has a holed or open structure so that foreign bodies or water can be drained away through its thickness thus preventing untimely jamming of the mechanism.

As can be seen in the figures, the moving locking pieces (locking piece 8 and ring 6) are preferably situated on so-called fixed parts (the side of the casing 10 or the seat retainer 2).

Figure 7:
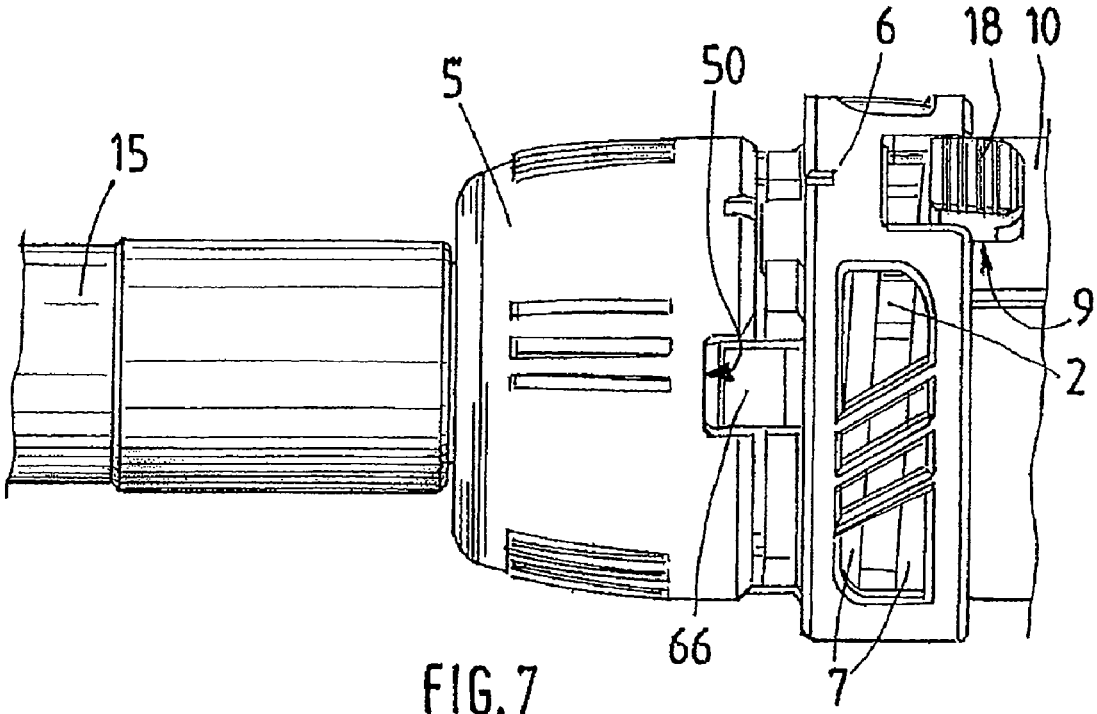
FIG. 7 depicts a side view of the assembly of FIG. 1 in the assembled position.
Figure 8:
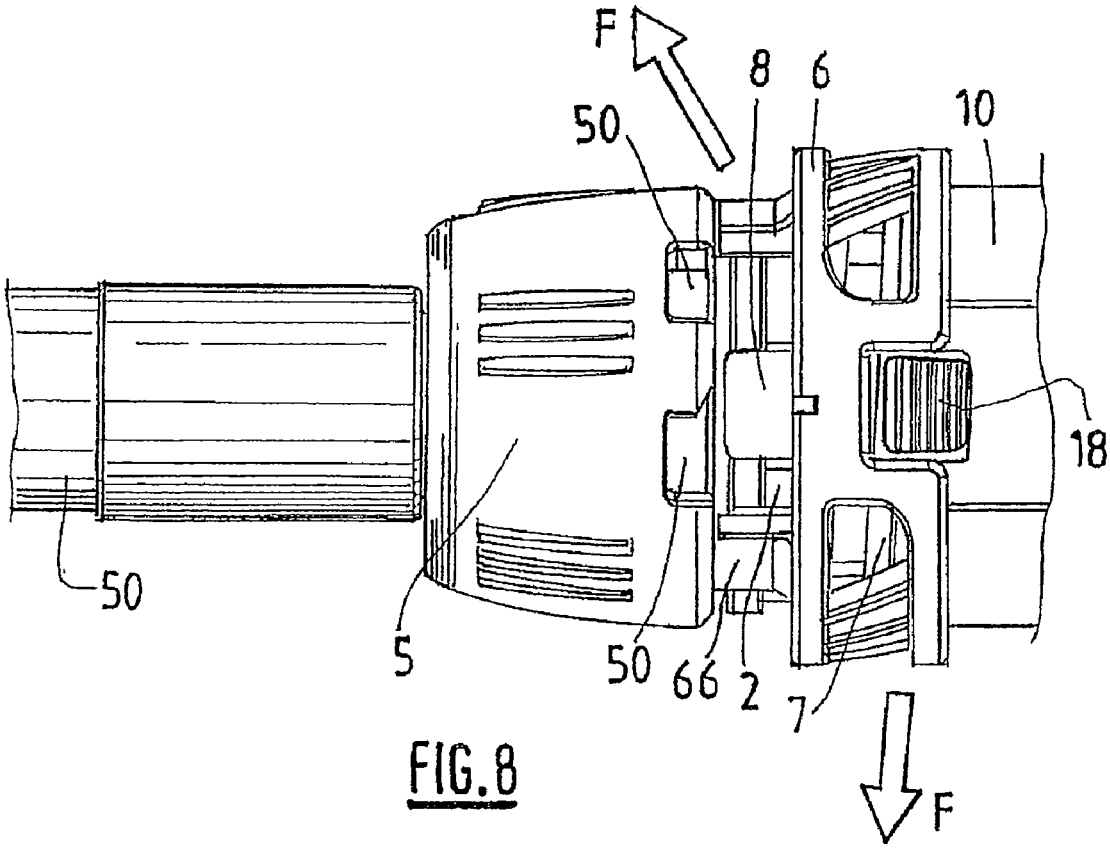
FIG. 8 depicts a side view of the assembly of FIG. 7, in a partially disassembled position.

As can be seen in FIGS. 7 and 8, the two quick connections can be locked independently.

Because of the structure according to the invention, when the second quick connection is locked (the head 5 of the hose 15 is in place on the second pressure-regulating stage at the casing 10 or the seat retainer 2), the first connection becomes non-unlockable. In other words, in order to be able to disconnect the first quick connection (seat retainer 2 and casing 10 or insert 140-casing 10 assembly) it is necessary beforehand to have released the second connection (head 5-seat retainer 2 or insert 140). What that means to say is that the head 5 of the hose has to be disconnected first in order then to allow the seat retainer 2 to be disconnected from the casing 10.

This also improves the safety of the whole against accidental disconnection.

In addition, given the environments (sea water, sand, etc.) to which the connections are subjected, it is advantageous for the moving part of the locking mechanism (locking piece(s)) to have openings to facilitate the circulation (drainage) of water so as to prevent sand or various particles that could jam the mechanism from becoming stuck.

Because of this, the fact that the moving locking piece 6, 8 is placed on the fixed part (side of the casing 10) is more dependable and more ergonomic (ease of grasping) because if the moving locking piece 6, 8 with the open structure was situated on the head 5, it would not be as easy for the user to turn this head.

If the system is incorrectly connected (the connection between the seat retainer 2 and the insert 140 or casing 10 and/or the connection between the connecting head 5 and the seat retainer 2) and under pressure, leaks F appear at the corresponding connections (FIG. 8).

These leaks F occur before the corresponding connection has been completely unscrewed (preferably at least two screw turns before the parts 5, 2; 2, 10 have been fully disconnected). These leaks F clearly indicate to the user that the system is incorrectly connected without giving rise to a dangerous situation (the leak is obvious before full disconnection occurs, this notably preventing the pressurized hose from effecting dangerous movements and allowing the user to stop disconnecting in time).

It will be readily understood that the invention proposes a simple and very dependable quick connection system that makes it possible to dispense with a high tightening torque and tightening tools.

The invention makes it possible to make connections (threaded connectors) out of plastic, without this imposing a limitation. Likewise, the invention makes it possible to envisage modes of connection other than conventional screw-fastening systems.

In the "entirely non-limiting" exemplary embodiment described hereinabove, the device comprises a pressure regulating valve seat retainer that is screwed selectively onto a tapped end of a seat retainer insert itself mounted in a bore in the casing 10.

Of course the invention could also be applied to instances in which the valve seat is also incorporated into the regulating valve retainer insert (that is to say where there is no separate seat retainer, the connecting head of the hose being screwed directly onto an end of the pressure regulating valve retainer insert). In this case, the selective locking quick connection may be provided between the connecting head 5 and the end of the insert 140.

Of course, the lockable connecting system described hereinabove can be used:

- only for the connection between the seat retainer and the casing or for the connection between the seat retainer and the insert or for the connection between the insert 140 and the casing 10,
- only for the connection between the connecting head 5 and the seat retainer or the connection between the connecting head 5 and the insert or for both of the abovementioned connections at once.

Thus, the lockable connecting system described hereinabove can be used for any connection between, on the one hand, the hose and, on the other hand, the demand valve (whether the hose is connected to a pressure regulating valve seat retainer or to an insert housing both the pressure regulating valve and its valve seat).

Alternatively or in addition, the lockable connecting system described hereinabove can be used for any connection between a component of the seat retainer type and demand valve provided with a pressure regulating valve retainer insert or any other fluidic connector.

The lockable connecting system is not restricted to the above exemplary embodiments but can be applied to the connecting of any fluidic connector in a device for supplying a diver with breathable gas.

What is claimed is:

1. A device comprising a demand valve for delivering breathable gas to a diver and at least one fluidic connector that can be selectively connected to the demand valve, the demand valve comprising a breathable gas supply inlet, the fluidic connector fastened removably at the supply inlet to carry breathable gas into the valve, the supply inlet of the demand valve and the fluidic connector comprising complementary respective catching members forming a removable fastening system, the complementary respective catching members comprising a screw thread and tapped thread system, wherein the demand valve and the fluidic connector comprise a blocking device for selectively blocking the connector on the demand valve when the connector is fastened to the demand valve via the catching members, the blocking device comprising a moving locking piece situated on the fluidic connector or on the demand valve, and an end stop situated on the demand valve or on the fluidic connector, the locking piece being able to be moved selectively between a first position of collaboration with the end stop corresponding to a configuration of blocking relative rotational movement between the demand valve and the fluidic connector and a second position of non-collaboration with the end stop corresponding to a position of unblocking the relative rotational movement between the demand valve and the fluidic connector, the locking piece being urged via a blocking device return member towards the first position in order automatically to block the connection of the fluidic connector to the demand valve when the seat retainer is fastened to the demand valve via the catching members.

2. The device of claim 1, wherein the demand valve comprises a casing provided with a port that forms the breathable gas supply inlet in which there is positioned an insert housing a pressure-regulating valve, the fluidic connector comprising a pressure-regulating valve seat retainer, the complementary catching members being situated at a first end of the pressure-regulating valve seat retainer and, at an outer end of the insert or at the port in the casing.

3. The device of claim 1, wherein the demand valve comprises a casing provided with a port in which there is positioned a support piece for at least a part of a valve mechanism for regulating the pressure of the breathable gas, the support piece having an inner first end directed towards the casing and a second end directed towards the outside of the casing, the second end of the support piece comprising a port forming the breathable gas supply inlet, and in that the fluidic connector comprises a gas supply pipe one end of which comprises a connecting head to be fastened removably to the second end of the support piece, the complementary catching members being situated at the connecting head of the supply pipe and at the second end of the support piece, the blocking device comprising a moving locking piece situated on the casing or on the support piece and an end stop situated on the connecting head for connection to the supply pipe, the locking piece being able to be moved selectively between a first position of collaboration with the end stop corresponding to a position of blocking a relative rotational movement between the connecting head and the support piece/casing assembly, and a second position of non-collaboration with the end stop corresponding to a position of unblocking the relative rotational movement between the connecting head and the support piece/casing assembly, the locking piece being urged towards its first position via a return member in order automatically to block the connection between the connecting head and the support piece when the connecting head is fastened to the support piece via the catching members.

4. The device of claim 3, wherein the support piece comprises an insert housing a pressure-regulating valve and a valve retainer separate from the insert housing a valve seat, the insert being housed in a port in the housing, the seat retainer having a first end coupled removably to the insert and a second end forming the second end of the support piece to be fastened removably to the connecting head.

5. The device of claim 4, wherein the first end of the pressure-regulating valve seat retainer and the second end of the insert comprise complementary catching members forming a system for removably fastening the seat retainer into the port of the casing and in that the demand valve or the seat retainer comprise a blocking device for selectively blocking the seat retainer on the demand valve when the seat retainer is fastened to the insert via the catching members, the blocking device comprising a moving locking piece situated on the seat retainer, and an end stop situated on the demand valve, the locking piece being able to be moved selectively between a first position of collaboration with the end stop corresponding to a configuration of blocking relative rotational movement between the demand valve and the seat retainer and a second position of non-collaboration with the end stop corresponding to a position of unblocking the relative rotational movement between the demand valve and the seat retainer, the locking piece being urged via a blocking device return member towards the first position in order automatically to block the connection of the seat retainer to the demand valve when the seat retainer is fastened to the demand valve via the catching members.

6. The device of claim 3, wherein the support piece comprises an insert housing both a pressure-regulating valve and a valve seat, the insert being housed in a port in the casing and comprising a first end housed in the casing and a second end forming the second end of the support piece to be fastened removably to the connecting head.

7. The device of claim 3, wherein the device further comprises a stop piece formed on the connecting head of the supply pipe or on the support piece, the stop piece being shaped in such a way as to limit, through abutment, the end position of fastening of the connecting head of the supply pipe to the second end of the support piece.

8. The device of claim 1, wherein the demand valve comprises a casing, the demand valve comprising a first fluidic connector that can be selectively connected to the casing via respective first catching members with screw thread and tapped thread, the demand valve device comprising a first blocking device comprising at least one first moving locking piece situated on the first fluidic connector and at least a first end stop situated on the demand valve, the first locking piece being able to be moved selectively between a first position of collaboration with a first end stop corresponding to a configuration of blocking a relative rotational movement between the casing and the first fluidic connector and a second position of non-collaboration with a first end stop corresponding to the unblocking of the relative rotational movement between the demand valve and the first fluidic connector, the first locking piece being urged towards its first position via a return member, the device comprising a second fluidic connector comprising a gas supply pipe one end of which comprises a connecting head to be fastened removably to one end of the first connector via second respective catching members with screw thread and tapped thread, the demand valve device comprising a second blocking device comprising at least a second moving locking piece situated on the first connector and at least one second end stop situated on the connecting head, the second locking piece being able to be moved selectively between a first position of collaboration with a second end stop to block the relative rotational movement between the head and the first connector and a second position of non-collaboration with a second end stop to unblock the relative rotational movement between the head and the first connector, the second locking piece being urged towards its first position via a return member.

9. The device of claim 8, wherein the first and second moving locking pieces are urged towards their respective first position by the one same return member.

10. The device of claim 8, wherein the second blocking device comprises several second moving locking pieces and several second end stops situated on the connecting head and defining several different possible positions of collaboration between locking pieces and end stops according to the relative angular positions of the head and of the first connector.

11. The device of claim 10, wherein the various positions of collaboration of the locking pieces with the end stop or stops form successive safety catches blocking the rotation of the head with respect to the connector.

12. The device of claim 8, wherein in the assembled position, the second blocking device and/of or the head forms an end stop limiting the movement of the first locking piece or pieces towards the second position thereof, in order to prevent the first catching members from being disassembled when the head has not previously been disconnected from the first connector.

13. The device of claim 4, wherein the complementary respective catching members are of the screw thread/tapped thread type.

14. The device of claim 5, wherein the support piece comprises an insert housing both a pressure-regulating valve and a valve seat, the insert being housed in a port in the casing and comprising a first end housed in the casing and a second end forming the second end of the support piece to be fastened removably to the connecting head.

15. The device of claim 6, wherein the second end of the support piece is removably fastened by screw fastening.

16. The device of claim 6, wherein the device further comprises a stop piece formed on the connecting head of the supply pipe or on the support piece, the stop piece being shaped in such a way as to limit, through abutment, the end position of fastening of the connecting head of the supply pipe to the second end of the support piece.

17. The device of claim 2, wherein the demand valve comprises a casing, the demand valve comprising a first fluidic connector that can be selectively connected to the casing via respective first catching members with screw thread and tapped thread, the demand valve device comprising a first blocking device comprising at least one first moving locking piece situated on the first fluidic connector and at least a first end stop situated on the demand valve, the first locking piece being able to be moved selectively between a first position of collaboration with a first end stop corresponding to a configuration of blocking a relative rotational movement between the casing and the first fluidic connector and a second position of non-collaboration with a first end stop corresponding to the unblocking of the relative rotational movement between the demand valve and the first fluidic connector, the first locking piece being urged towards its first position via a return member, the device comprising a second fluidic connector comprising a gas supply pipe one end of which comprises a connecting head to be fastened removably to one end of the first connector via second respective catching members with screw thread and tapped thread, the demand valve device comprising a second blocking device comprising at least a second moving locking piece situated on the first connector and at least one second end stop situated on the connecting head, the second locking piece being able to be moved selectively between a first position of collaboration with a second end stop to block the relative rotational movement between the head and the first connector and a second position of non-collaboration with a second end stop to unblock the relative rotational movement between the head and the first connector, the second locking piece being urged towards its first position via a return member.

18. The device of claim 9, wherein the second blocking device comprises several second moving locking pieces and several second end stops situated on the connecting head and defining several different possible positions of collaboration between locking pieces and end stops according to the relative angular positions of the head and of the first connector.

19. The device of claim 11, wherein, in the assembled position, the second blocking device or the head forms an end stop limiting the movement of the first locking piece or pieces towards the second position thereof, in order to prevent the first catching members from being disassembled when the head has not previously been disconnected from the first connector.

* * * * *